United States Patent [19]

Yano et al.

[11] Patent Number: 4,683,352

[45] Date of Patent: Jul. 28, 1987

[54] CHANGEOVER SWITCH

[75] Inventors: Takashi Yano, Yokohama; Yasuo Yoneyama, Kawasaki, both of Japan

[73] Assignee: Fujisoku Electric Co., Ltd., Kawasaki, Japan

[21] Appl. No.: 884,183

[22] Filed: Jul. 10, 1986

[30] Foreign Application Priority Data

Jul. 17, 1985 [JP] Japan ..... 60-109269[U]

[51] Int. Cl.[4] ..... H01H 9/00; H01H 21/04; H01H 1/58

[52] U.S. Cl. ..... 200/6 R; 200/68.2; 200/237

[58] Field of Search ..... 200/6 R, 6 B, 16 R, 200/16 C, 67 R, 68.1-68.3, 284, 237, 238, 1 V, 16 F; 361/410

[56] References Cited

U.S. PATENT DOCUMENTS

| | | | |
|---|---|---|---|
| 3,462,564 | 8/1969 | Bedocs | 200/16 C |
| 3,996,430 | 12/1976 | Eberwein et al. | 361/410 |
| 4,072,839 | 2/1978 | Spedate | 200/67 R X |
| 4,259,552 | 3/1981 | Swann | 200/6 R |

*Primary Examiner*—J. R. Scott

*Attorney, Agent, or Firm*—Frishauf, Holtz, Goodman & Woodward

[57] ABSTRACT

A changeover switch comprising a casing body including two switch mechanisms each having two fixed contacts, a common contact located between the fixed contacts, and a movable contact strip attached to the common contact and adapted to alternatively touch the fixed contacts. A partition wall is provided between the switch mechanisms. Conductors are provided inside the partition wall for cross-connecting the fixed contacts of the switch mechanisms.

3 Claims, 12 Drawing Figures

CHANGEOVER SWITCH

BACKGROUND OF THE INVENTION

The present invention relates to a changeover switch used to change the rotational direction of, for example, a motor.

FIGS. 10(A) and 10(B) show a prior art switch of this type. This switch is a modified version of conventional double-pole double throw switch 11 whose fixed terminals 13, 14, 15, and 16 are cross-connected by means of lead wires 17 and 18. In this arrangement, when DC voltage is supplied to common terminals 19 and 20, and if knob 10 is shifted, an inverted version of the voltage can, for example, be obtained at terminals 13 and 15, depending on the shift direction.

In FIG. 11, showing another prior art switch, like reference numerals are used to designate like portions as shown in FIGS. 10(A) and 10(B). Fixed terminals 13, 14, 15, and 16 of double-pole double throw switch 11 are connected by connecting means 21. The connecting means includes member 22, formed of, for example, synthetic resin, and conductors 23 and 24 arranged intersecting each other inside member 22. Both ends of conductors 23 and 24 are connected individually to fixed terminals 13, 14, 15, and 16. Connecting means 21 is encased in cover 25 which is provided at the bottom of switch 11. This arrangement can provide the same functions as the foregoing example.

In the prior art changeover switches described above, however, the fixed terminals are cross-connected outside casing body 11*a* by means of lead wires 17 and 18, or conductors 23 and 24. Inevitably, therefore, the switches are bulky.

Moreover, the connection between fixed terminals 13 to 16, using lead wires 17 and 18, or conductors 23 and 24, is performed separately from the assembling of switch 11, thereby resulting in an increased number of assembly processes.

SUMMARY OF THE INVENTION

The object of the present invention is to provide a changeover switch, dispensing with an increase in size and permitting a reduced number of assembling processes.

The above object of the invention is achieved by a changeover switch which comprises a casing body; a pair of switch means located inside the casing body and each including two fixed contacts, a common contact located between the fixed contacts, and a movable contact strip attached to the common contact and adapted to alternatively touch the fixed contacts; a partition wall provided between the paired switch means in the casing body, to divide the switch means; and connecting means located inside the partition wall and cross-connecting the fixed contacts of the two switch means.

DETAILED DESCRIPTION OF THE PREFERRED EMBODIMENTS

Figure 1:
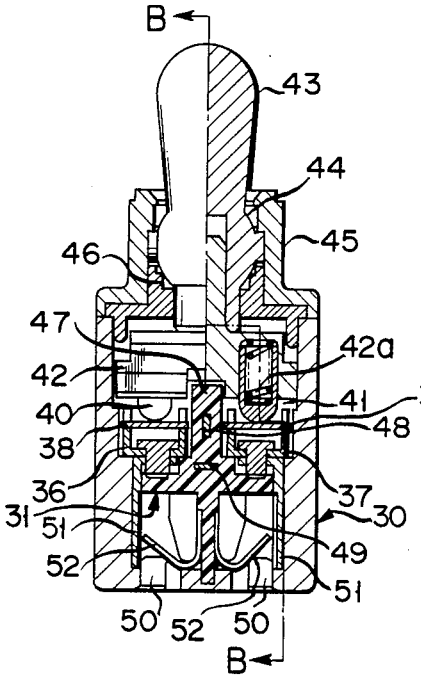
FIG. 1 is a side view partially in section, taken along line A—A in FIG. 2 showing a changeover switch according to a first embodiment of the present invention.
Figure 2:
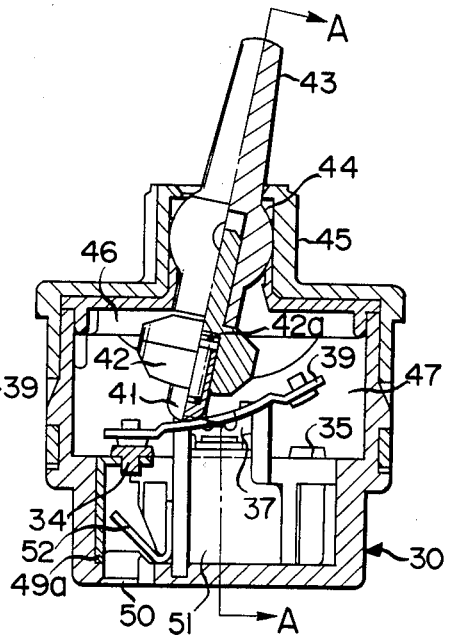
FIG. 2 is a side view partially in section taken line B—B of FIG. 1.
Figure 3:
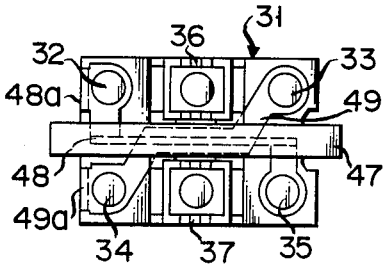
FIG. 3 is a plan view extractively showing a retainer.
Figure 4:
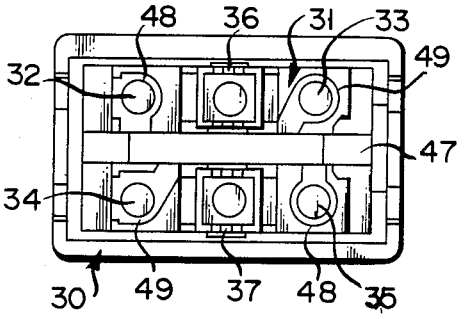
FIG. 4 is a plan view showing the inside of a casing body.

Referring now to the accompanying drawings of FIGS. 1 to 5, a first embodiment of the present invention will be described in detail:

In FIGS. 1 and 2, retainer 31 made of a resin is housed in casing body 30. As shown in FIGS. 3 and 4, fixed contacts 32, 33, 34, and 35 are arranged at predetermined intervals on the upper surface of retainer 31. Common contacts 36 and 37 are arranged between contacts 32 and 33 and between contacts 34 and 35, respectively. Movable contact strips 38 and 39 are movably attached to contacts 36 and 37, respectively. The end portions of strips 38 and 39 can be alternatively in contact with, respectively, contacts 32 or 33, and contacts 34 or 35. Movable elements 40 and 41 slidably abut against contact strips 38 and 39, respectively. The respective proximal end portions of elements 40 and 41 are projectably held inside one end portion of operator 42. Coil spring 42*a* is embedded in each of elements 40 and 41, whereby the elements are urged toward their corresponding movable contact strips 38 and 39 at all times. The other end portion of operator 42 is inserted in one end portion of knob 43. Spherical portion 44 is formed in the middle of knob 43. It is rockably held by cover 45 and backup member 46, which are mounted on casing body 30.

Figure 5:
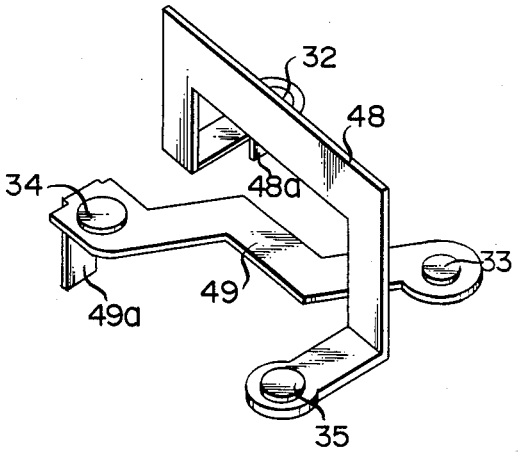
FIG. 5 is a perspective view showing an arrangement of conductors.

Partition wall 47, which is integral with retainer 31, is formed between the first set of contacts, including fixed contacts 32 and 33, and common contact 36, and the second set, including fixed contacts 34 and 35, and common contact 37, which constitute two switch mechanisms. As shown in FIG. 3, wall 47 contains therein conductor 48, which connects contacts 32 and 35, and conductor 49, which connects contacts 33 and 34. Conductors 48 and 49 are formed in the partition wall by insert-molding. As shown in FIG. 5, conductor 48 is bent upward, so as to intersect conductor 49, and output terminals 48*a* and 49*a* are formed at those ends of conductors 48 and 49, respectively, on the side of fixed contacts 32 and 34.

Apertures 50 are bored through the bottom portion of casing body 30, corresponding to fixed contacts 32, 33, 34, and 35, and common contacts 36 and 37, individually. Arranged inside the apertures are output terminals 48*a* and 49*a*, of conductors 48 and 49, and connecting terminals 51 which are electrically connected to common contacts 36 and 37, individually. Also, a conductive elastic member 52 is located inside each aperture 50. It serves to press a lead wire (not shown) in aperture 50 against its corresponding connecting terminal 51.

Retainer 31 is housed in casing body 30 with fixed contacts 32 to 35, common contacts 36 and 37, and conductors 48 and 49 incorporated in place.

In this arrangement, when knob 43 is rocked, movable contact strips 38 and 39 rotate. If strips 38 and 39 are brought into contact with fixed contacts 32 and 34, respectively, DC voltage supplied to common contacts 36 and 37 appears, as an output, at contacts 32 and 34 (or output terminals 48*a* and 49*a*) without changing its polarity. If contact strips 38 and 39 are brought into contact with contacts 33 and 35, respectively, an inverted version of the DC voltage applied to contacts 36 and 37 is delivered from contacts 32 and 34 (or terminals 48*a* and 49*a*).

According to the embodiment described above, conductors 48 and 49, which cross-connect fixed contacts 32 to 35, are contained in partition wall 47 inside casing body 30. In other words, these conductors, unlike the conventional ones, are not located outside the casing body. Accordingly, the switch can be prevented from becoming bulky.

Moreover, conductors 48 and 49 are built in advance, into partition wall 47 which is formed integrally with retainer 31, and are incorporated, together with the retainer, in casing body 30. Thus, the conductors are set in the switch body as the switch is assembled, so that the number of assembly processes can be reduced.

Figure 6:
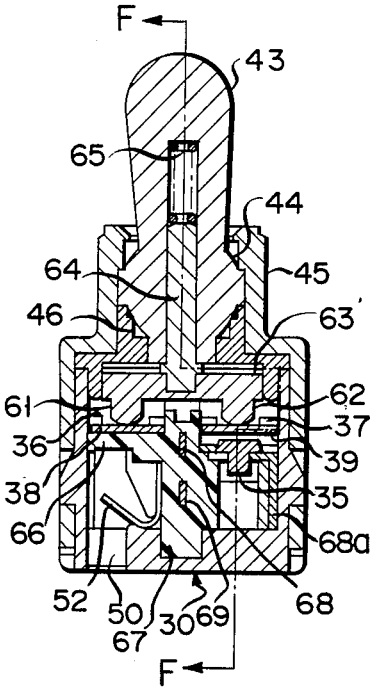
FIG. 6 is a split side sectional view showing a changeover switch according to a second embodiment of the invention with movable element 62 and its peripheral parts taken along line C-D of FIG. 7, and movable element 61 and its peripheral parts taken along line C-E of FIG. 7.
Figure 7:
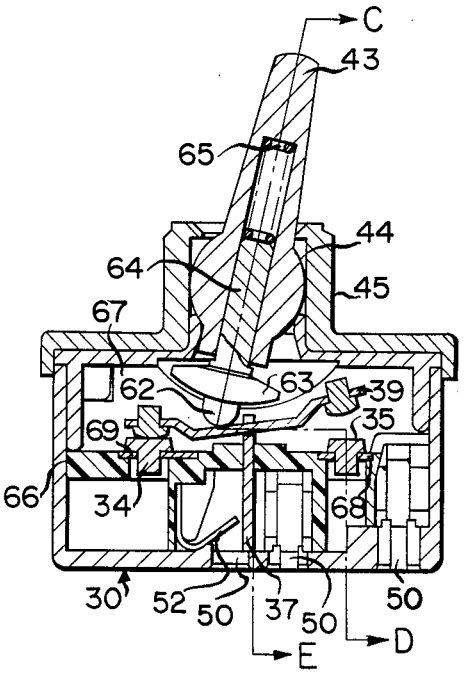
FIG. 7 is a side sectional view taken along line F-F of FIG. 6.

FIGS. 6 to 9 show a second embodiment of the present invention. In these drawings, like reference numerals are used to designate like portions as shown in FIGS. 1 to 5. Only different portions will be described in detail below:

In FIGS. 6 and 7, movable elements 61 and 62 are formed integrally with operator 63. Stem 64 of operator 63 is projectably held inside knob 43, and is urged by spring 65 which is contained in knob 43. Thus, elements 61 and 62 are pressed against movable contact strips 38 and 39, respectively.

Figure 8:
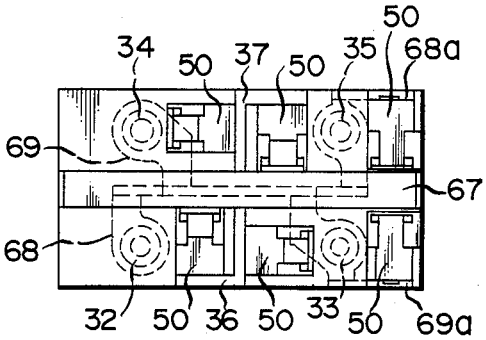
FIG. 8 is a bottom view extractively showing a retainer of the switch of FIG. 6.

On the other hand, casing body 30 contains retainer 66 which carries fixed contacts 32 to 35, and common contacts 36 and 37. As shown in FIG. 8, retainer 66 is provided with partition wall 67 which divides the two switch mechanisms. Conductors 68 and 69, which connects contacts 32 to 35 inclusive, are formed inside wall 67 by insert-molding.

Figure 9:
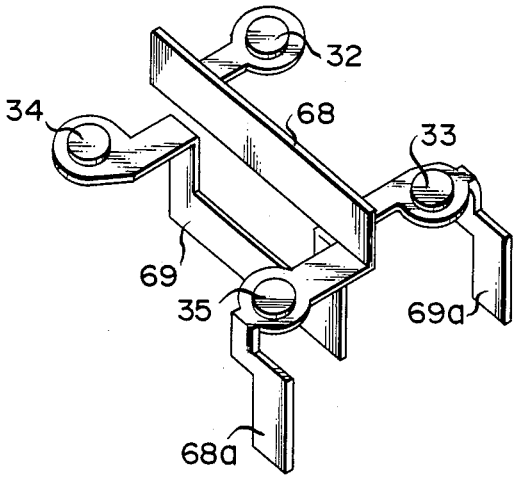
FIG. 9 is a perspective view showing an arrangement of conductors of the switch of FIG. 6.
Figure 10A:
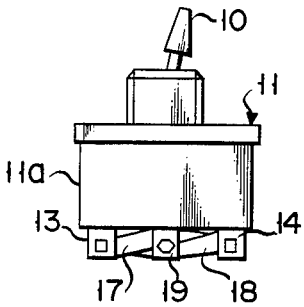
FIG. 10A (PRIOR ART)
FIG. 10(A) is a side view showing a configuration of a prior art changeover switch.
Figure 10B:
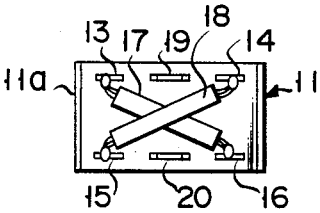
FIG. 10B (PRIOR ART)
FIG. 10(B) is a bottom view of the switch of FIG. 10(A)
Figure 11:
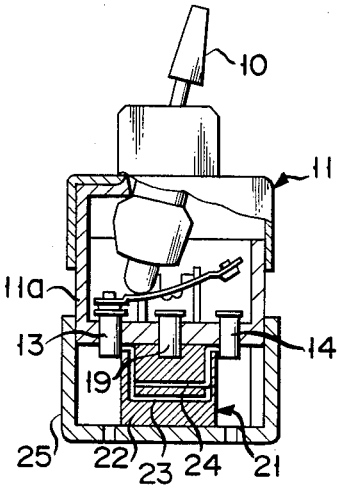
FIG. 11 (PRIOR ART)
FIG. 11 is a cutaway side view showing a configuration of another prior art changeover switch.

Referring now to FIG. 9, conductors 68 and 69 can be seen. The central portion of conductor 68, connecting fixed contacts 32 and 35, is bent upward, while that of conductor 69, connecting contacts 33 and 34, is bent downward. Output terminals 68*a* and 69*a* are formed at those ends of conductors 68 and 69, respectively, on the side of fixed contacts 33 and 35. Terminals 68*a* and 69*a*, and common contact strips 36 and 37, are located inside their corresponding apertures 50.

In this arrangement, when knob 43 is rocked, movable contact strips 38 and 39 rotate. If strips 38 and 39 are brought into contact with fixed contacts 33 and 35, respectively, DC voltage supplied to common contacts 36 and 37 appears, as an output, at contacts 33 and 35 (or output terminals 68*a* and 69*a*) without changing its polarity. If contact strips 38 and 39 are brought into touch with contacts 32 and 34, respectively, an inverted version of the DC voltage applied to contacts 36 and 37 is delivered from contacts 33 and 35 (or terminals 68*a* and 69*a*).

The second embodiment can provide the same effects of the first embodiment. According to the second embodiment, moreover, conductor 69 is bent downward, and conductors 68 and 69 are located in the lower part of partition wall 67, so that casing body 30, and therefore the height of the whole switch can be reduced.

What is claimed is:

1. A changeover switch comprising:

a casing body;

first switch means including first and second fixed contacts located inside the casing body, a first common contact located between the first and second fixed contacts, and a first movable contact strip means attached to the first common contact for alternatively touching the first and second fixed contacts;

second switch means including a third and fourth fixed contacts located inside the casing body, a second common contact located between the third and fourth fixed contacts, and a second movable contact strip means attached to the second common contact for alternatively touching the third and fourth fixed contacts;

operating means for actuating the first and second movable contact strip means concurrently in order to connect the first and third fixed contacts to the first and second common contacts, respectively, or connect the second and fourth fixed contacts to the first and second common contacts, respectively;

a partition wall provided between the first and second switch means in the casing body, to divide the switch means; and first and second connecting means located inside the partition wall and cross-connecting the first and fourth fixed contacts and the second and third fixed contacts, respectively.

2. The changeover switch according to claim 1, wherein said first and second switch means are provided on a retainer formed integrally with the partition wall, said retainer being housed in the casing body.

3. The changeover switch according to claim 5, wherein said first and second connecting means are formed in the partition wall by insert-molding.

* * * * *